US010976054B2

(12) United States Patent
Paller

(10) Patent No.: US 10,976,054 B2
(45) **Date of Patent: *Apr. 13, 2021**

(54) MULTI-CAVITY OVEN APPLIANCE WITH NATURAL AND FORCED CONVECTION

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 122 days.

This patent is subject to a terminal disclaimer.

(21) Appl. No.: 16/424,565

(22) Filed: May 29, 2019

(65) Prior Publication Data

US 2020/0378609 A1 Dec. 3, 2020

(51) Int. Cl.

| | |
|---|---|
| ***F24C 3/08*** | (2006.01) |
| ***F24C 3/12*** | (2006.01) |
| ***F24C 15/32*** | (2006.01) |
| ***F24C 15/02*** | (2006.01) |
| ***F24C 3/00*** | (2006.01) |

(52) U.S. Cl.

CPC ..... *F24C 3/082* (2013.01); *F24C 3/004* (2013.01); *F24C 3/122* (2013.01); *F24C 15/028* (2013.01); *F24C 15/322* (2013.01)

(58) Field of Classification Search

CPC ..... F24C 3/082; F24C 3/122; F24C 15/322; F24C 15/028; F24C 3/004

See application file for complete search history.

(56) References Cited

U.S. PATENT DOCUMENTS

| | | | | |
|---|---|---|---|---|
| 4,357,522 A * | 11/1982 | Husslein | F24C 15/325 219/400 |
| 4,480,628 A | 11/1984 | Simpson | |
| 6,761,159 B1 * | 7/2004 | Barnes | F24C 15/2007 126/21 R |
| 6,913,012 B2 * | 7/2005 | Divett | F24C 15/006 126/21 A |

(Continued)

FOREIGN PATENT DOCUMENTS

| | | |
|---|---|---|
| CA | 2475035 C | 12/2009 |
| FR | 2430568 A1 | 2/1980 |
| WO | WO2016013752 A1 | 1/2016 |

*Primary Examiner* — David J Laux
*Assistant Examiner* — Nikhil P Mashruwala
(74) *Attorney, Agent, or Firm* — Dority & Manning, P.A.

(57) ABSTRACT

An oven appliance defines a vertical direction, a lateral direction and a transverse direction. The vertical, lateral and transverse directions are mutually perpendicular. The oven appliance includes a cabinet extending between a first side portion and a second side portion along the lateral direction. The cabinet also extends between a top portion and a bottom portion along the vertical direction. The cabinet defines an upper cooking chamber positioned adjacent the top portion of the cabinet and a lower cooking chamber positioned adjacent the lower portion of the cabinet. The oven appliance also includes a single heat source in thermal communication with an ambient environment around the oven appliance by natural convection and a fan operable to provide direct thermal communication from the single heat to one or both of the upper cooking chamber and the lower cooking chamber by forced convection.

15 Claims, 9 Drawing Sheets

(56) References Cited

U.S. PATENT DOCUMENTS

| | | | | |
|---|---|---|---|---|
| 6,967,310 | B2 * | 11/2005 | Austin | F24C 15/2014 219/408 |
| 7,411,160 | B2 * | 8/2008 | Duncan | F24C 15/325 126/21 A |
| 7,726,295 | B2 * | 6/2010 | Elkasevic | F24C 15/006 126/198 |
| 7,762,250 | B2 * | 7/2010 | Elkasevic | F24C 15/006 126/198 |
| 9,677,774 | B2 * | 6/2017 | McKee | F24C 15/007 |
| 10,113,749 | B2 * | 10/2018 | Yancey | B21D 39/021 |
| 2013/0025364 | A1 * | 1/2013 | Bach | G01F 1/688 73/204.23 |
| 2015/0101592 | A1 * | 4/2015 | Cadima | F24C 3/087 126/41 R |
| 2020/0300379 | A1 * | 9/2020 | Wilder | F16K 31/1262 |
| 2020/0305630 | A1 * | 10/2020 | Paller | F24C 3/008 |

* cited by examiner

MULTI-CAVITY OVEN APPLIANCE WITH NATURAL AND FORCED CONVECTION

FIELD OF THE INVENTION

The present subject matter relates generally to multi-cavity oven appliances, such as double oven range appliances.

BACKGROUND OF THE INVENTION

Various oven appliance may include more than one cooking chamber. For example, such multi-cavity oven appliances may include double oven range appliances having upper and lower cooking chambers. A user of the double oven range appliances may conveniently utilize either or both of the upper and lower cooking chambers to cook food items. In certain double oven range appliance, the upper cooking chamber is smaller than the lower cooking chamber. Thus, the user may utilize the upper cooking chamber to cook smaller food items and the lower cooking chamber to cook larger food items.

Heating a multi-cavity oven appliance to properly cook/bake foods requires being able to supply heat to each oven cavity substantially independent of the other cavity or cavities. Traditionally, this has been accomplished by supplying a bake burner to each oven cavity, a broil burner to at least one of the cavities and optionally an additional heat source with a fan for convection. This requires independent burners or electric elements for each of these heat sources. Such configurations can be costly, reduce the usable cooking volume within the oven appliance, add complexity, and may reduce reliability of the oven appliance. For example, multi-cavity oven appliances utilizing gas systems may face baking performance limitations. Only one gas burner can be ignited in any cavity at a given time because simultaneous burner operation may result in poor combustion. In such systems, transitioning between bake and broil can require significant time since one burner needs to be turned off and then the other ignited. As another example, typical multi-cavity oven appliances only provide convection heating in one cavity or the additional cost of another convection system must be added to provide convection in other cavities.

Accordingly, a multi-cavity oven appliance with features for providing flexible operation of the oven appliance, e.g., by selectively directing heat to one or more of the multiple cavities would be useful. In addition, a multi-cavity oven appliance with features which provide flexible operation while minimizing the footprint of the heating system within the oven appliance would be useful.

BRIEF DESCRIPTION OF THE INVENTION

Aspects and advantages of the invention will be set forth in part in the following description, or may be apparent from the description, or may be learned through practice of the invention.

In one exemplary embodiment, an oven appliance is provided. The oven appliance defines a vertical direction, a lateral direction and a transverse direction. The vertical, lateral and transverse directions are mutually perpendicular. The oven appliance includes a cabinet extending between a first side portion and a second side portion along the lateral direction. The cabinet also extends between a top portion and a bottom portion along the vertical direction. The cabinet defines an upper cooking chamber positioned adjacent the top portion of the cabinet and a lower cooking chamber positioned adjacent the lower portion of the cabinet. The oven appliance also includes a single heat source selectively in direct thermal communication with one or both of the upper cooking chamber and the lower cooking chamber by forced convection or an ambient environment around the oven appliance by natural convection.

In another exemplary embodiment, an oven appliance is provided. The oven appliance includes a cabinet with an upper cooking chamber defined in the cabinet adjacent a top portion of the cabinet and a lower cooking chamber defined in the cabinet below the upper cooking chamber and adjacent a lower portion of the cabinet. The oven appliance also includes a single heat source in direct thermal communication with an ambient environment around the oven appliance by natural convection. The oven appliance further includes a fan operable to provide direct thermal communication from the single heat to one or both of the upper cooking chamber and the lower cooking chamber by forced convection.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
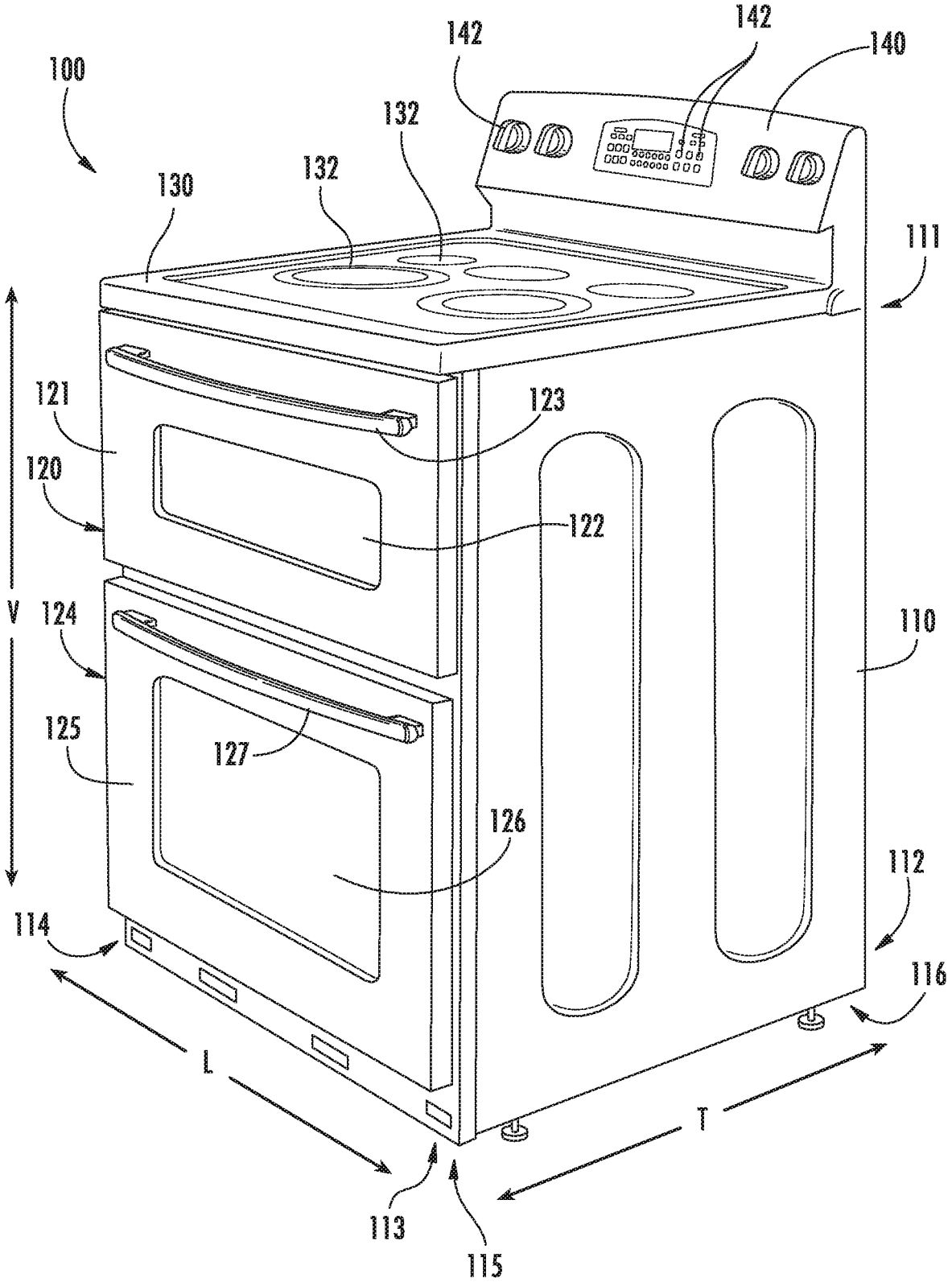
FIG. 1 provides a perspective view of an exemplary oven range appliance including a single heat source, an upper cooking chamber, a lower cooking chamber, and a plurality of fans according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a multi-cavity oven range appliance 100 according to an exemplary embodiment of the present subject matter. In the example illustrated in FIG. 1 the oven range appliance is a double oven appliance including two cavities. It is to be understood that such is by way of example only, additional embodiments of the present disclosure may include three or more cavities. In the illustrated example, the multi-cavity oven appliance 100 includes a separate door for each cavity, e.g., an upper door 121 and a lower door 125 corresponding to the upper and lower cavities, respectively. In additional embodiments, a single door may be provided for simultaneous access to all of the multiple cavities within the oven appliance 100. Other combinations and variations are also possible, for example a triple cavity oven appliance with two doors, etc.

As may be seen in FIG. 1, oven appliance 100 defines a vertical direction V, a lateral direction L, and a transverse direction T. The vertical, lateral and transverse directions are mutually perpendicular and form an orthogonal direction system.

Oven appliance 100 includes an insulated cabinet 110. Cabinet 110 extends between a top portion 111 and a bottom portion 112, e.g., along the vertical direction V. Thus, top and bottom portions 111, 112 of cabinet 110 are spaced apart from each other, e.g., along the vertical direction V. Cabinet 110 also extends between a first side portion 113 and a second side portion 114, e.g., along the lateral direction L. Thus, first and second side portions 113, 114 of cabinet 110 are spaced apart from each other, e.g., along the lateral direction L. For example, from the perspective of a user standing in front of the oven appliance 100, e.g., to reach into one of the cavities and/or to access the controls, the first side portion 113 may be a right side portion and the second side portion 114 may be a left side portion. Cabinet 110 further extends between a front portion 115 and a back portion 116, e.g., along the transverse direction T. Thus, front and back portions 115, 116 of cabinet 110 are spaced apart from each other, e.g., along the transverse direction T.

In the illustrated example, the oven appliance 100 includes a cooktop 130 positioned at or adjacent top portion 111 of cabinet 110. Cooktop 130 includes various heating elements 132, such as gas burners, electric resistance elements, induction elements, etc., that are configured for heating cookware positioned thereon. In additional embodiments, the oven appliance 100 may be a built-in oven or a wall oven, e.g., without a cooktop 130 thereon.

As indicated in FIG. 1, cabinet 110 also defines an upper cooking chamber 120 and a lower cooking chamber 124. Thus, oven appliance 100 is generally referred to as a double oven range appliance. As will be understood by those skilled in the art, the double oven range appliance 100 is provided by way of example only, and the present subject matter may be used in any suitable multi-cavity oven appliance, e.g., a triple cavity oven appliance (or more), a double cavity wall oven appliance, etc., in various combinations.

Upper cooking chamber 120 is positioned at or adjacent top portion 111 of cabinet 110. Conversely, lower cooking chamber 124 is positioned at or adjacent bottom portion 112 of cabinet 110. Thus, upper and lower cooking chambers 120, 124 are spaced apart from each other along the vertical direction V. Upper and lower cooking chambers 120, 124 can have any suitable size relative to each other. For example, as shown in FIG. 1, upper cooking chamber 120 may be smaller than lower cooking chamber 124.

Upper and lower cooking chambers 120, 124 are configured for receipt of one or more food items to be cooked. The upper door 121 and the lower door 125 are movably attached or coupled to cabinet 110, e.g., rotatably coupled with hinges, in order to permit selective access to upper cooking chamber 120 and lower cooking chamber 124, respectively. Handles 123, 127 are mounted to upper and lower doors 121, 125 to assist a user with opening and closing doors 121, 125 in order to access cooking chambers 120, 124. As an example, a user can pull on handle 123 mounted to upper door 121 to open or close upper door 121 and access upper cooking chamber 120. Glass window panes 122, 126 provide for viewing the contents of upper and lower cooking chambers 120, 124 when doors 121, 125 are closed and also assist with insulating upper and lower cooking chambers 120, 124.

A control panel 140 of oven appliance 100 is positioned at top portion 111 and back portion 116 of cabinet 110. Control panel 140 includes user inputs 142. Control panel 140 provides selections for user manipulation of the operation of oven appliance 100. For example, a user can touch control panel 140 to trigger one of user inputs 142. In response to user manipulation of user inputs 142, various components of the oven appliance 100, such as various heating elements, can be operated.

As may be seen in FIGS. 2 through 5, upper cooking chamber 120 and lower cooking chamber 124 may be thermally isolated from one another. For example, an insulated partition 150 may extend between the upper cooking chamber 120 and the lower cooking chamber 124. As will be understood, the insulated partition 150 may be positioned between the upper cooking chamber 120 and the lower cooking chamber 124 along the vertical direction V. Further, the insulated partition 150 may extend predominantly along the lateral direction L and the transverse direction T, e.g., the major dimensions of the insulated partition 150 may lie along the lateral and transverse directions L and T, whereas the vertical dimension of the insulated partition 150 may be much smaller than the lateral dimension or the transverse dimension. For example, the insulated partition 150 may extend from the left side 114 of the cabinet 110 to the right side 113 of the cabinet 110 along the lateral direction L and may extend from the front portion 115 of the cabinet 110 to the back portion 116 of the cabinet 110 along the transverse direction T.

The oven appliance 100 includes one or more heating elements 160 which are configured to provide heat, e.g., convection heat via heated air, to the cooking chambers 120 and 124. Heating elements 160 may be any suitable heating element, such as electric resistance heating elements, gas burners, microwave elements, etc. In some embodiments, more than one type of heating element may be provided, e.g., an electric resistance heating element and a gas burner may be provided in combination. The one or more heating elements 160 may be selectively in thermal communication with one or more of the cavities in the multi-cavity oven appliance 100 and/or an ambient environment around the oven appliance 100. For example, the heating element(s) 160 may be selectively in thermal communication with one or both of the upper cooking chamber 120 and the lower cooking chamber 124 by forced convection when one or more fans 190, 192, and/or 194 are activated in the illustrated example embodiment. In embodiments where more than one heating element 160 is provided, the heating elements 160 may collectively define a single heat source, e.g., the heating elements 160 may be located together to minimize a footprint of the heating elements 160 within the overall volume of the cabinet 110. As such, single heat source is used herein to refer to heat from a single location within the oven appliance 100, and the heat may be provided by one or more heating elements 160 which are positioned together in the single location.

As illustrated in FIGS. 2-9, the heating element 160 may be positioned outside of the cooking chambers 120 and 124. For example, the heating element 160 may be separated from the cooking chambers 120 and 124 by a second insulated partition 152, whereby the heating element 160 is in thermal communication with the cooking chambers 120 and 124 only by convection, as will be described in more detail below. The second insulated partition 152 may be positioned below the lower cooking chamber 124 along the vertical direction V and above the heating element 160 along the vertical direction V. Similar to the first insulated partition 150 described above, the second insulated partition 152 may extend predominantly along the lateral direction L and the transverse direction T. For example, the second insulated partition 152 may extend from the left side 114 of the cabinet 110 to the right side 113 of the cabinet 110 along the lateral direction L and may extend from the front portion 115 of the cabinet 110 to the back portion 116 of the cabinet 110 along the transverse direction T.

As mentioned above, the heating element 160 may be selectively in thermal communication with one or both of the upper cooking chamber 120 and the lower cooking chamber 124 or an ambient environment around the oven appliance 100. For example, the heating element 160 may be selectively in direct thermal communication with one or both of the cooking chambers 120 and 124 or the ambient environment. As will be described in more detail below, the heating element 160 may be selectively in direct fluid communication with one or both of the cooking chambers 120 and 124 to provide heated air 1000 directly from the heating element 160 to one or both cooking chambers 120 and 124. Such selectivity may be provided by operating one or more fans 190, 192, 194, to direct the heated air 1000 to a corresponding cavity or cavities 120/124. Such thermal communication may be provided by a plurality of ducts extending between the heating element 160 and the cooking chambers 120 and 124. For example, the oven appliance 100 may include a first duct 170 that extends directly from the heating element 160 to a vent 172 in fluid communication with the ambient environment around the oven appliance, a second duct 172 that extends directly from the heating element 160 to a broil outlet 175 in the upper cooking chamber 120, a third duct 176 that extends directly from an inlet 177 to a bake outlet 178 in the upper cooking chamber 120, and a fourth duct 180 that extends directly from an inlet 182 to a bake outlet 184 in the lower cooking chamber 124. The oven appliance 100 may also include a first fan 190 positioned and configured to urge air from the first duct 170 into the second duct 174, a second fan 192 positioned and configured to urge air from the first duct 170 into the third duct 176, and a third fan 194 positioned and configured to urge air from the first duct 170 into the fourth duct 180. As will be described in more detail below, selective activation or deactivation of the fans 190, 192, and 194 may provide selective thermal communication from the heating element 160 to one or both of the cooking chambers 120 and 124.

Figure 2:
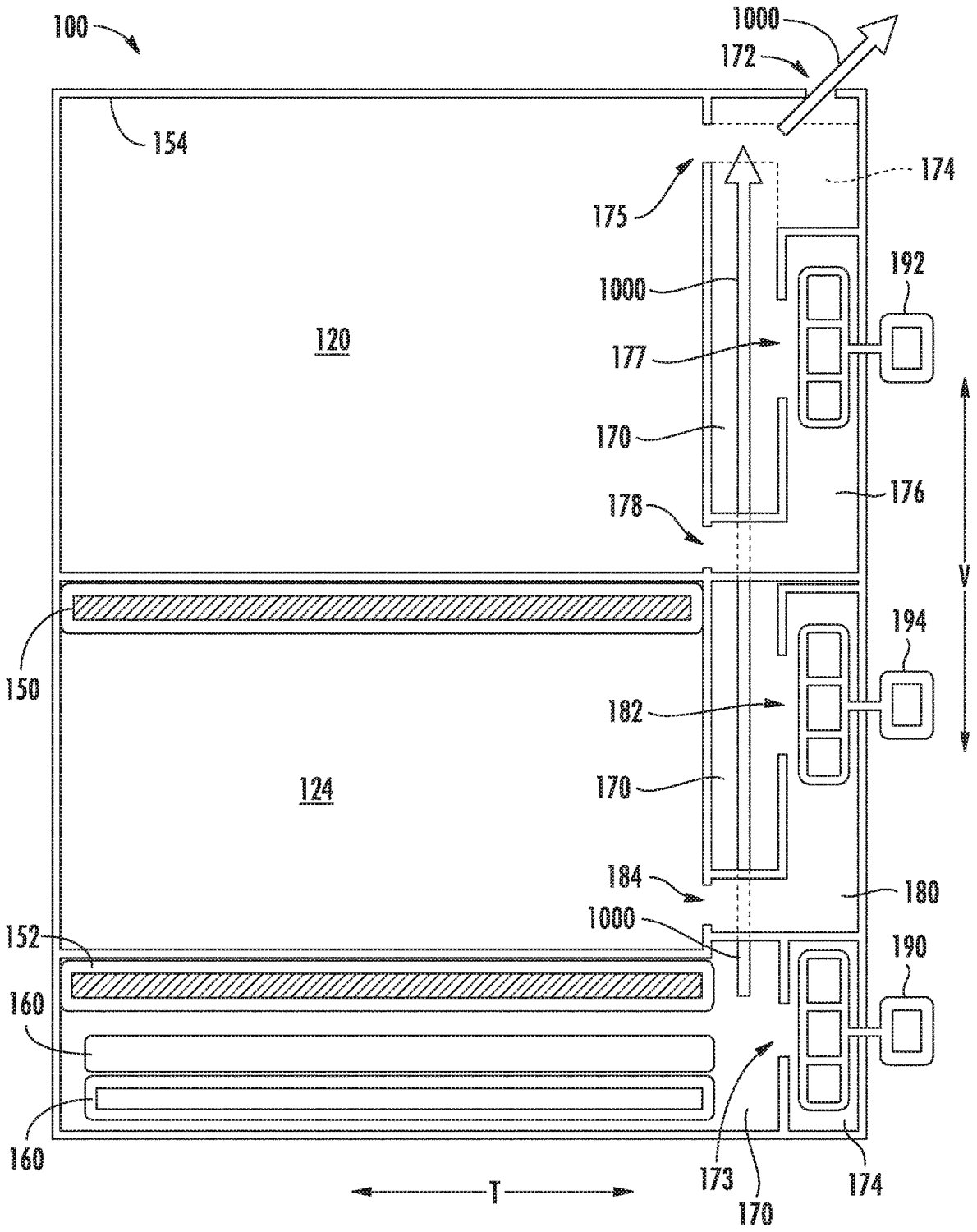
FIG. 2 provides a schematic illustration of the exemplary multi-cavity oven appliance of FIG. 1 with the fans deactivated such that the single heat source is in thermal communication with an ambient environment by natural convection.

FIG. 2 schematically illustrates a condition wherein the heating element 160 is in direct thermal communication with the ambient environment through the first duct 170 and the vent 172. Where the heating element 160 is positioned below the vent 172 as in the illustrated example embodiment, heated air 1000 from the heating element 160 will flow, e.g., rise, from the heating element 160 into and through the first duct 170 to the vent 172 by natural convection. For example, residual heat from the heating element 160 after a cooking operation is completed may travel to the vent 172, and from there to the ambient environment outside of the oven appliance 100, through the first duct 170 by natural convection. Such configuration may advantageously reduce or avoid overheating, e.g., overcooking, of items, e.g., food items, in the cooking chambers 120 and/or 124. Thus, the heating element 160 and the vent 172 may be configured for direct thermal communication from the heating element 160 to the vent 172 in the upper cooking chamber 120 by natural convection. For example, the heated air 1000 may rise to the vent 172 when the first fan 190, second fan 192, and third fan 194 are deactivated.

Figure 3:
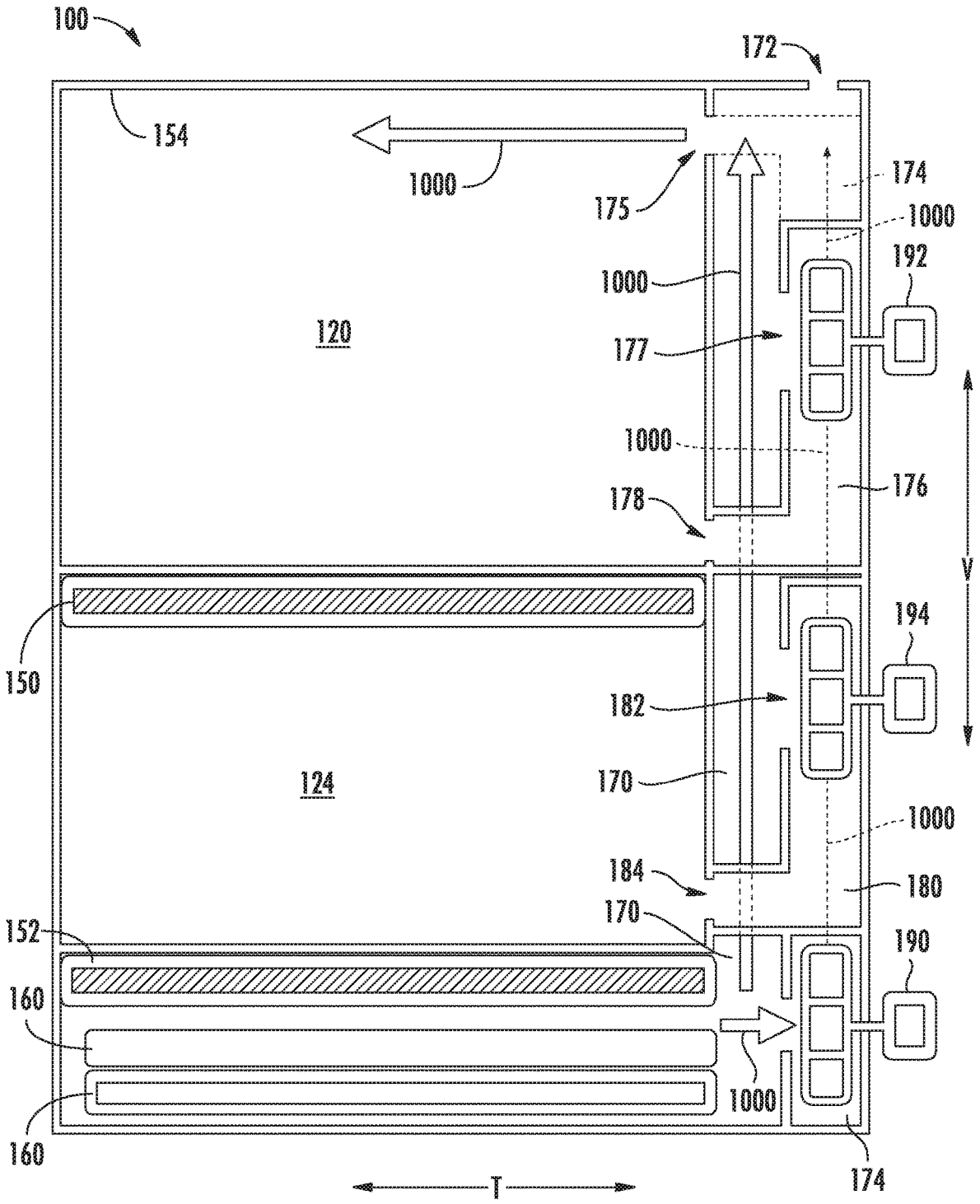
FIG. 3 provides a schematic illustration of the exemplary multi-cavity oven appliance of FIG. 1 with a first fan activated, whereby the single heat source is in thermal communication with a broil outlet in the upper cooking chamber by forced convection.

Turning now specifically to FIG. 3, an upper cooking chamber 120 broil operation is illustrated schematically. As shown, the heating element 160 may be in direct thermal communication with the upper cooking chamber 120 via the second duct 174. In particular, the heating element 160 may be in thermal communication with the broil outlet 175 of the upper cooking chamber 120 via the second duct 174. As will be understood by those of ordinary skill in the art, the broil outlet 175 may be positioned at or near a top wall 154 of the upper cooking chamber 120. For example, in some embodiments, the broil outlet 175 of the upper cooking chamber 120 may be proximate the top wall 154 as illustrated, e.g., in FIG. 3. As shown, when the first fan 190 is activated, the heated air 1000 rising through the first duct 170 may be diverted from a natural path and forced or urged by the first fan 190 into the second duct 174, such as via the inlet 173 (FIG. 2) of the second duct 174, as illustrated. Thus, the first fan 190 may provide forced convection from the heating element 160 to the broil outlet 175 of the upper cooking chamber 120. As shown, the inlet 173 of the second duct 174 may be positioned in the first duct 170 and/or in fluid communication with the first duct 170. The second duct 174 maybe positioned below the vent 172 along the vertical direction V. For example, the inlet 173 of the second duct 174 may be positioned vertically below the vent 172. Thus, in at least some embodiments, the inlet 173 of the second duct 174 may be positioned at an intermediate point in the first duct 170 between the heating element 160 and the vent 172. Where the inlet 173 of the second duct 174 is below the vent 172, some or all of the heated air 1000 may be diverted from the natural path by the first fan 190 before the heated air 1000 reaches the vent 172 and the heated air 1000 may then be routed through the second duct 174 to the broil outlet 175, e.g., some or all of the heated air 1000 may be diverted from the first duct 170 and urged into and through the second duct 174 by the first fan 190. Thus, the heating element 160 and the upper cooking chamber 120 may be configured for thermal communication from the heating element 160 to the broil outlet 175 in the upper cooking chamber 120 by forced convection.

Figure 4:
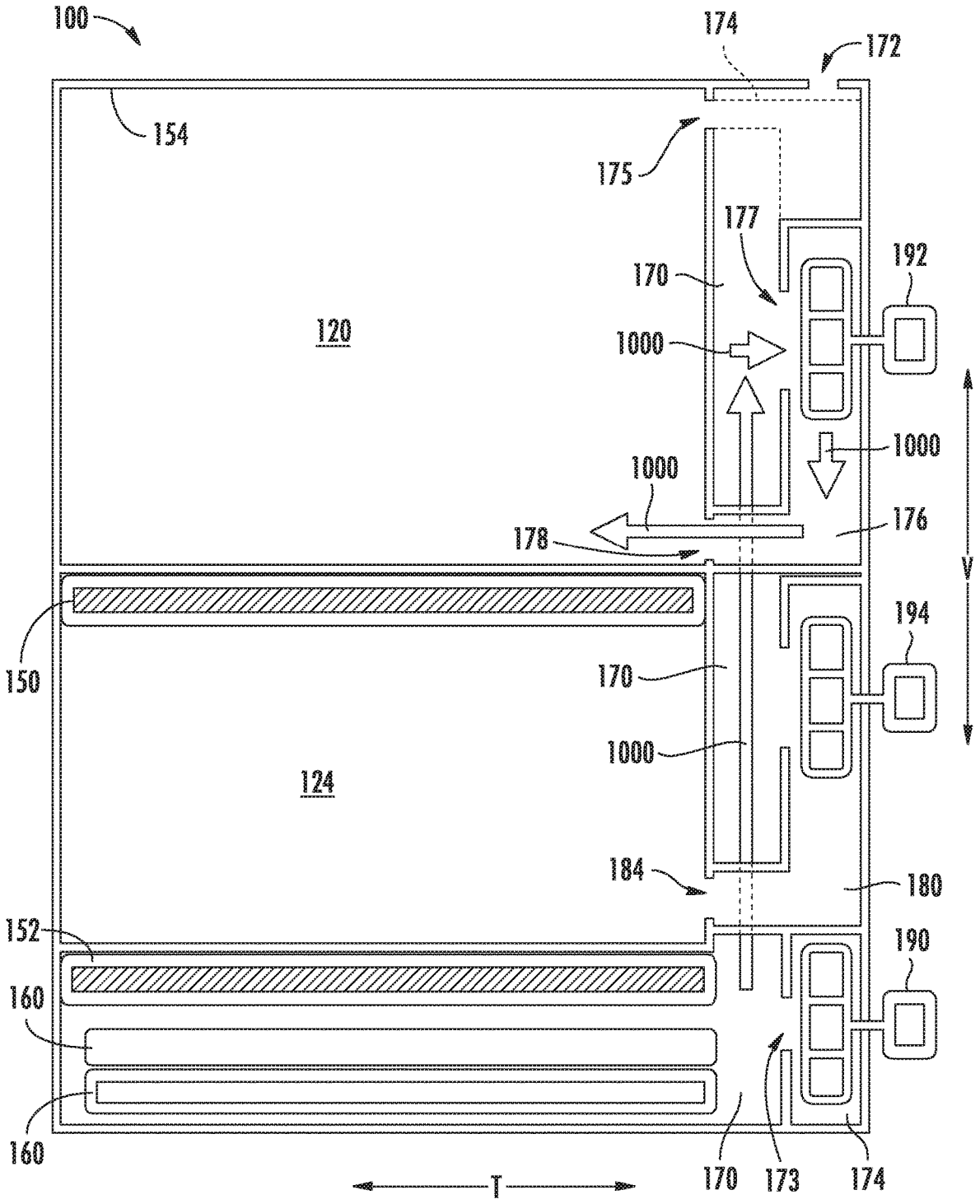
FIG. 4 provides a schematic illustration of the exemplary multi-cavity oven appliance of FIG. 1 with a second fan activated, whereby the single heat source is in thermal communication with a bake outlet in the upper cooking chamber by forced convection.

Turning now to FIG. 4, a bake operation in the upper cooking chamber 120 is schematically depicted, e.g., where heated air 1000 is provided to the bake outlet 178 of the upper cooking chamber 120. As shown, when the second fan 192 is activated, some or all of the heated air 1000 rising through the first duct 170 may be diverted from a natural path and forced or urged by the second fan 192 into the third duct 176, such as via the inlet 177 of the third duct 176, as illustrated. Thus, the second fan 192 may provide forced convection from the heating element 160 to the bake outlet 178 of the upper cooking chamber 120. As shown, the inlet 177 of the third duct 176 may be positioned in the first duct 170 and/or in fluid communication with the first duct 170. The third duct 176 may be positioned below the vent 172 along the vertical direction V. For example, the inlet 177 of the third duct 176 may be positioned vertically below the vent 172. Also by way of example, the inlet 177 of the third duct 176 may be positioned vertically above the heating element 160 and the inlet 173 of the second duct 174. Thus, in at least some embodiments, the inlet 177 of the third duct 176 may be positioned at an intermediate point in the first duct 170 between the heating element 160 and the vent 172 in the upper cooking chamber 120. Where the inlet 177 of the third duct 176 is below the vent 172, some or all of the heated air 1000 may be diverted from the natural path by the second fan 192 before the heated air 1000 reaches the vent 172 and the heated air 1000 may then be routed through the third duct 176 to the bake outlet 178, e.g., some or all of the heated air 1000 may be diverted from the first duct 170 and urged into and through the third duct 176 by the second fan 192. Thus, the heating element 160 and the upper cooking chamber 120 may be configured for thermal communication from the heating element 160 to the upper cooking chamber 120 by forced convection using either or both of the first fan 190 and the second fan 192.

Figure 5:
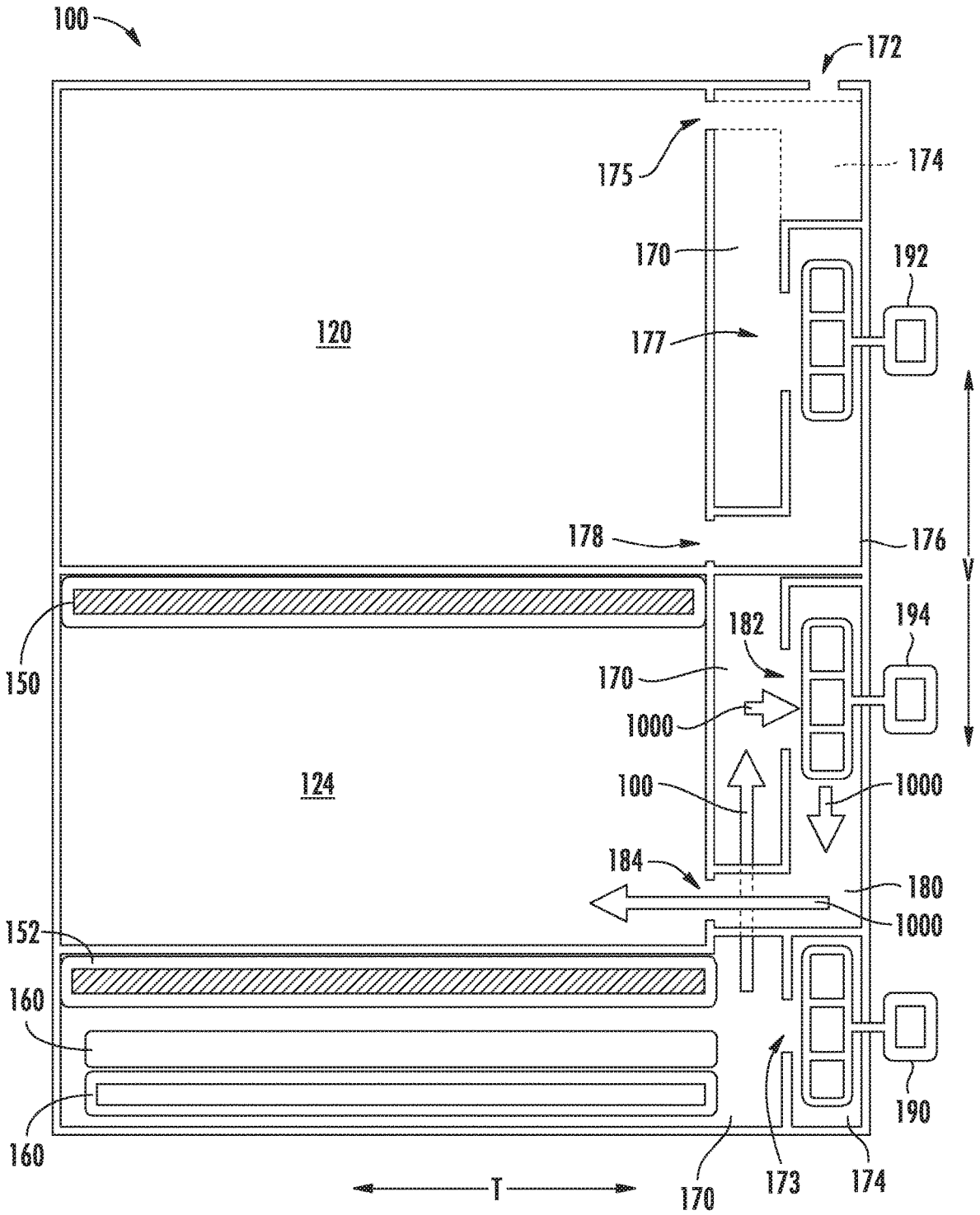
FIG. 5 provides a schematic illustration of the exemplary multi-cavity oven appliance of FIG. 1 with a third fan activated, whereby the single heat source is in thermal communication with a bake outlet in the lower cooking chamber by forced convection.

Turning now to FIG. 5, a bake operation in the lower cooking chamber 124 is schematically depicted, e.g., where heated air 1000 is provided to the bake outlet 184 of the lower cooking chamber 124. As shown, when the third fan 194 is activated, some or all of the heated air 1000 rising through the first duct 170 may be diverted from the natural path and forced or urged by the third fan 194 into the fourth duct 180, such as via the inlet 182 of the fourth duct 180, as illustrated. Thus, the third fan 194 may provide forced convection from the heating element 160 to the bake outlet 184 of the lower cooking chamber 124. As shown, the inlet 182 of the fourth duct 180 may be positioned in the first duct 170 and/or in fluid communication with the first duct 170 and below the vent 172 along the vertical direction V. For example, the inlet 182 of the fourth duct 180 may be positioned vertically below the vent 172 and above the heating element 160 and the inlet 173 of the second duct 174. Thus, in at least some embodiments, the inlet 182 of the fourth duct 180 may be positioned at an intermediate point in the first duct 170 between the heating element 160 and the vent 172. Also by way of example, the inlet 182 of the fourth duct 180 may be positioned vertically below the inlet 177 of the third duct 176. Where the inlet 182 of the fourth duct 180 is below the inlet 177 of the third duct 176 and the vent 172, some or all of the heated air 1000 may be diverted from the natural path by the third fan 194 before the heated air 1000 reaches the vent 172 and/or the inlet 177 of the third duct 176. The heated air 1000 may then be routed through the fourth duct 180 to the bake outlet 184, e.g., may be urged into and through the fourth duct 180 by the third fan 194.

Figure 6:
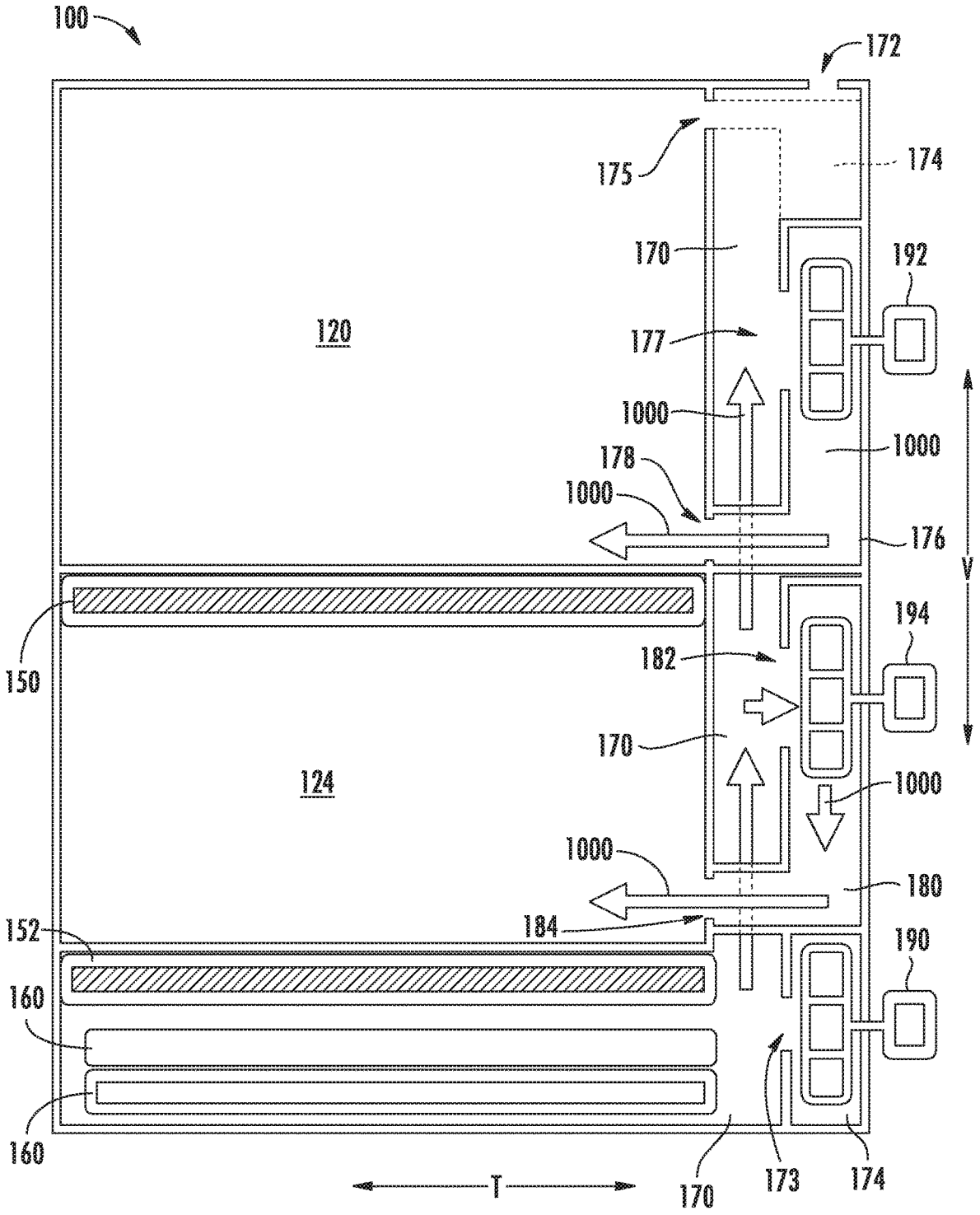
FIG. 6 provides a schematic illustration of the exemplary multi-cavity oven appliance of FIG. 1 with the second and third fans activated.

As mentioned, the heating element 160 may selectively be in thermal communication with both of the upper cooking chamber 120 and the lower cooking chamber 124. For example, as shown in FIG. 6, when the second fan 192 is activated while the third fan 194 is also activated, a first portion of the heated air 1000 may be urged into the third duct 176 via the inlet 177 by the second fan 192, and a second portion of the heated air 1000 may be urged into the fourth duct 180 via the inlet 182 by the third fan 194. The first portion of the heated air 1000 may then be urged through the third duct 176 from the inlet 177 of the third duct 176 to the bake outlet 178 in the upper cooking chamber 120, and the second portion of the heated air 1000 may then be urged through the fourth duct 180 to the bake outlet 184 in the lower cooking chamber 124. Thus, the heating element 160 may be in thermal communication with both of the upper cooking chamber 120 and the lower cooking chamber 124 when both the second fan 192 and the third fan 194 are activated at the same time, whereupon a baking operation may be provided in both the upper cooking chamber 120 and the lower cooking chamber 124.

Figure 7:
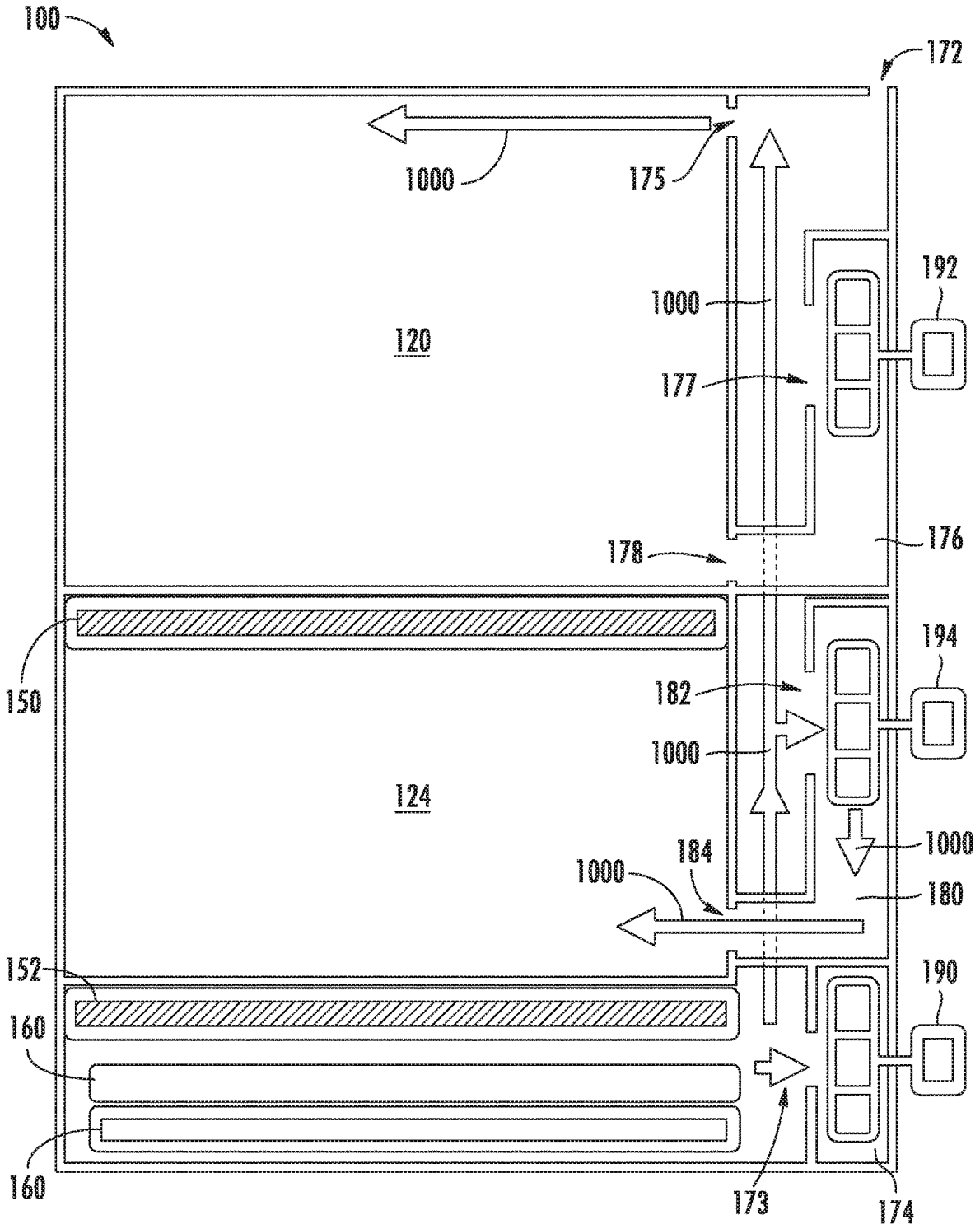
FIG. 7 provides a schematic illustration of the exemplary multi-cavity oven appliance of FIG. 1 with the first and third fans activated.

As another example, FIG. 7 illustrates the heating element 160 in thermal communication with both of the upper cooking chamber 120 and the lower cooking chamber 124 for a broil operation in the upper cooking chamber 120 and a bake operation in the lower cooking chamber 124. As illustrated in FIG. 7, when the first fan 190 is activated while the third fan 194 is also activated, a first portion of the heated air 1000 may be urged into the second duct 174 via the inlet 173 by the first fan 190, and a second portion of the heated air 1000 may be urged into the fourth duct 180 via the inlet 182 by the third fan 194. The first portion of the heated air 1000 may then be urged through the second duct 174 from the inlet 173 of the second duct 174 to the broil outlet 175 in the upper cooking chamber 120, and the second portion of the heated air 1000 may then be urged through the fourth duct 180 to the bake outlet 184 in the lower cooking chamber 124. Thus, the heating element 160 may be in thermal communication with both of the upper cooking chamber 120 and the lower cooking chamber 124 when both the first fan 190 and the third fan 194 are activated at the same time, whereupon a broil operation may be provided in the upper cooking chamber 120 and a baking operation may be provided in the lower cooking chamber 124.

Figure 8:
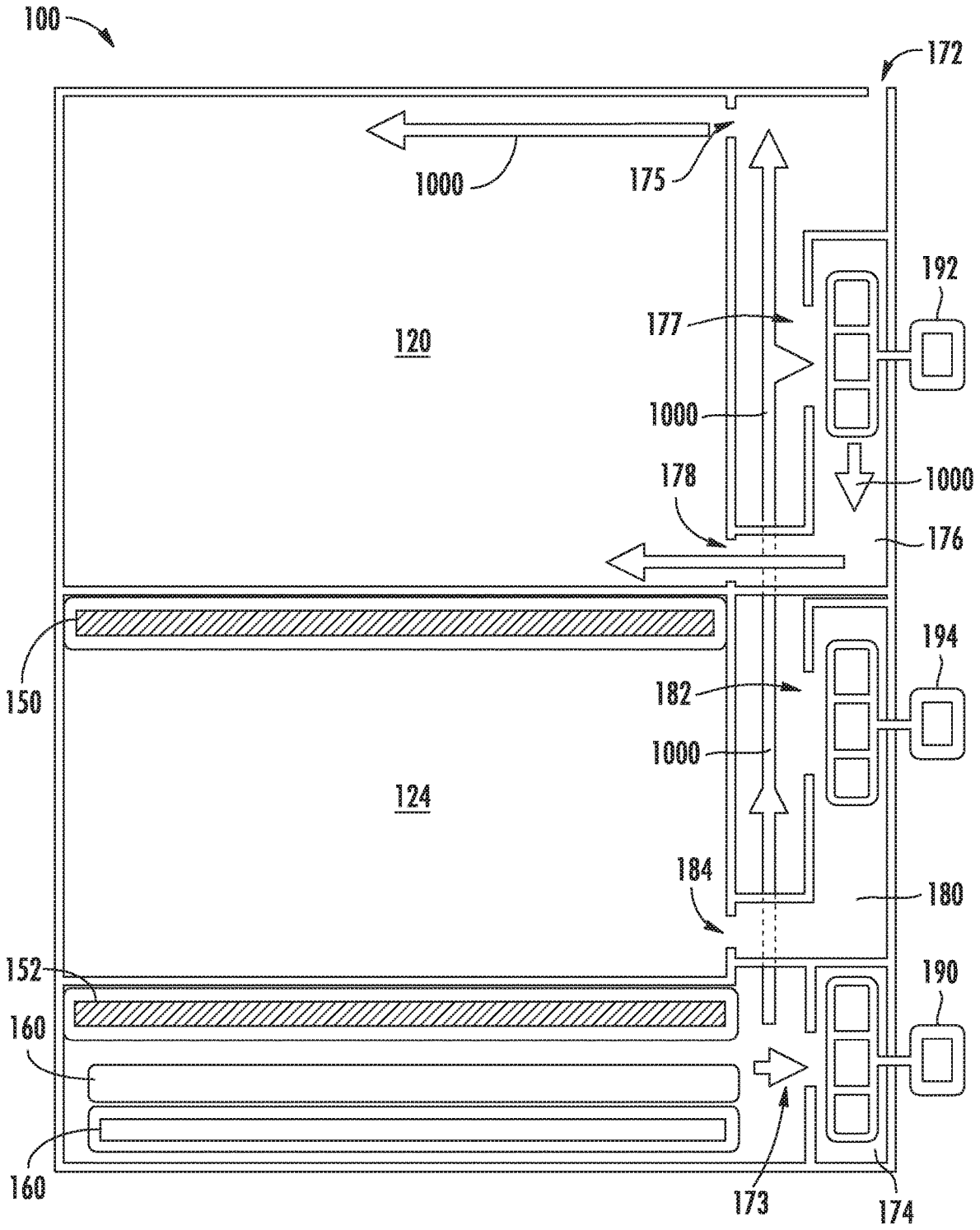
FIG. 8 provides a schematic illustration of the exemplary multi-cavity oven appliance of FIG. 1 with the first and second fans activated.

FIG. 8 schematically illustrates operation of the oven appliance 100 when both the first fan 190 and the second fan 192 are activated at the same time while the third fan 194 is not activated. In this operation, bake and broil may both be provided in the upper cooking chamber 120. For example, a first portion of the heated air 1000 may be urged into the second duct 174 via the inlet 173 by the first fan 190, and a second portion of the heated air 1000 may be urged into the third duct 176 via the inlet 177 by the second fan 192. The first portion of the heated air 1000 may then be urged through the second duct 174 from the inlet 173 of the second duct 174 to the broil outlet 175 in the upper cooking chamber 120, and the second portion of the heated air 1000 may then be urged through the third duct 176 to the bake outlet 178 in the upper cooking chamber 120.

Figure 9:
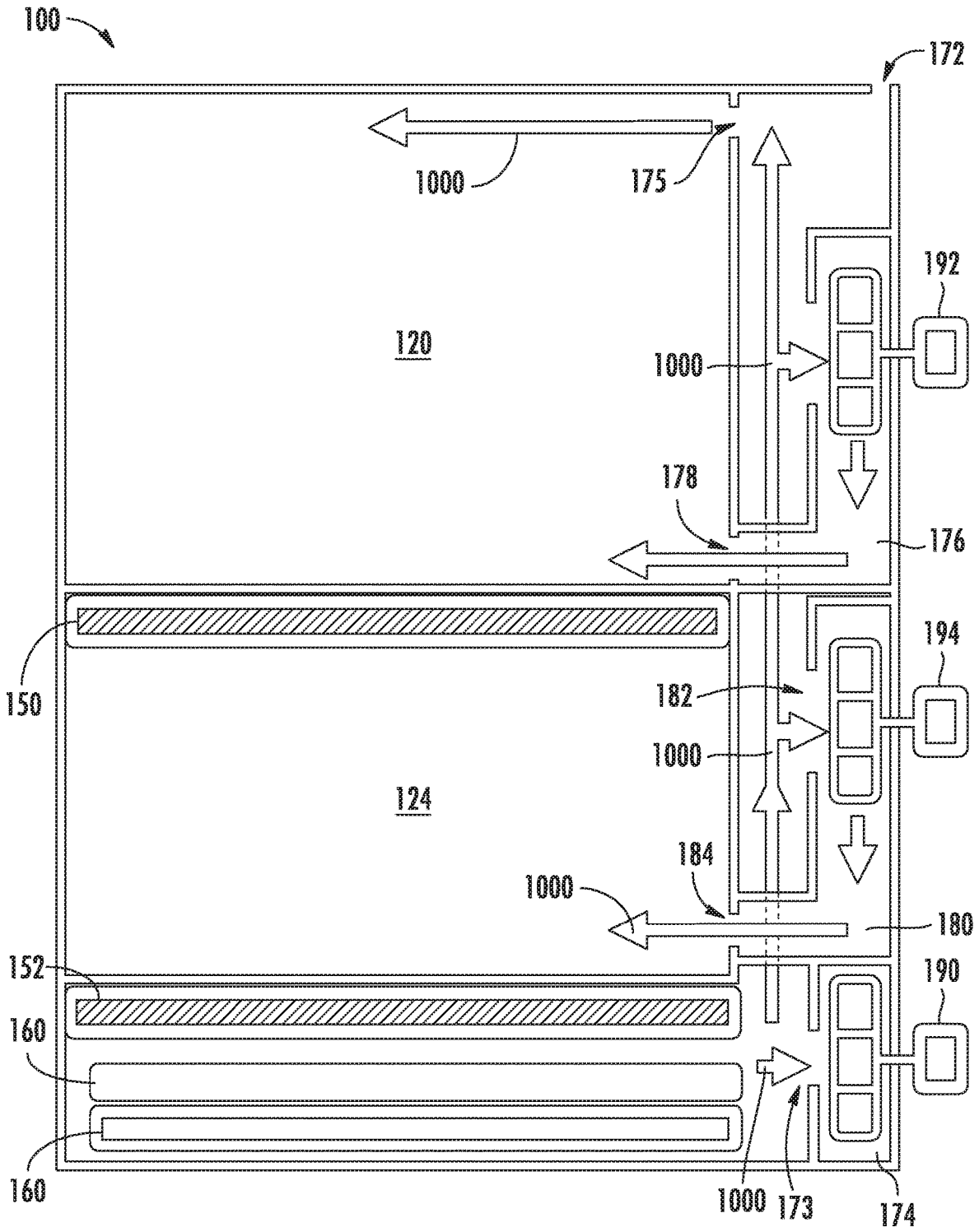
FIG. 9 provides a schematic illustration of the exemplary multi-cavity oven appliance of FIG. 1 with the first, second, and third fans activated.

FIG. 9 schematically illustrates operation of the oven appliance 100 when the first fan 190, the second fan 192, and the third fan 194 are all activated at the same time. In this operation, bake and broil may both be provided in the upper cooking chamber 120 as well as a bake operation in the lower cooking chamber 124. In embodiments where the single heat source includes multiple co-located heating elements 160, more than one heating element 160 may be activated during such operations where more than one fan, such as all three fans 190, 192, and 194, are activated. For example, as illustrated in FIG. 9, a first portion of the heated air 1000 may be urged into the second duct 174 via the inlet 173 by the first fan 190, a second portion of the heated air 1000 may be urged into the third duct 176 via the inlet 177 by the second fan 192, and a third portion of the heated air 1000 may be urged into the fourth duct 180 via the inlet 182 by the third fan 194. The first portion of the heated air 1000 may then be urged through the second duct 174 from the inlet 173 of the second duct 174 to the broil outlet 175 in the upper cooking chamber 120, the second portion of the heated air 1000 may then be urged through the third duct 176 to the bake outlet 178 in the upper cooking chamber 120, and the third portion of the heated air 1000 may then be urged through the fourth duct 180 to the bake outlet 184 in the lower cooking chamber 124.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a vertical direction, a lateral direction and a transverse direction, the vertical, lateral and transverse directions being mutually perpendicular, the oven appliance comprising:

a cabinet extending between a first side portion and a second side portion along the lateral direction, the cabinet also extending between a top portion and a bottom portion along the vertical direction, the cabinet defining an upper cooking chamber positioned adjacent the top portion of the cabinet and a lower cooking chamber positioned adjacent the lower portion of the cabinet; and a single heat source selectively in direct thermal communication with one or both of the upper cooking chamber and the lower cooking chamber by forced convection or an ambient environment around the oven appliance by natural convection;

a first duct extending from the single heat source to a vent in fluid communication with the ambient environment around the oven appliance, the single heat source selectively in thermal communication with the ambient environment by natural convection through the first duct and the vent;

a second duct extending from an inlet to a broil outlet in the upper cooking chamber; and a fan configured to urge heated air from the single heat source into the second duct, wherein the inlet of the second duct is positioned at an intermediate point in the first duct between the single heat source and the vent, whereby the fan is configured to divert heated air from the first duct into the second duct.

2. The oven appliance of claim 1, wherein the fan is positioned in the second duct.

3. The oven appliance of claim 1, wherein the fan is a first fan, further comprising a third duct extending to a bake outlet in the upper cooking chamber and a second fan configured to urge heated air from the single heat source into the third duct.

4. The oven appliance of claim 3, wherein the third duct extends from an inlet to the bake outlet in the upper cooking chamber, the inlet of the third duct positioned vertically below the vent, whereby the second fan is configured to divert heated air from the first duct into the third duct.

5. The oven appliance of claim 3, further comprising a fourth duct extending to a bake outlet in the lower cooking chamber and a third fan configured to urge heated air from the single heat source into the third duct.

6. The oven appliance of claim 5, wherein the fourth duct extends from an inlet to the bake outlet in the lower cooking chamber, the inlet of the fourth duct positioned vertically below the vent, whereby the third fan is configured to divert heated air from the first duct into the fourth duct.

7. The oven appliance of claim 1, further comprising a fan configured to provide forced convection from the single heat source to one of a broil outlet in the upper cooking chamber, a bake outlet in the upper cooking chamber, and a bake outlet in the lower cooking chamber.

8. The oven appliance of claim 1, wherein the upper cooking chamber is thermally isolated from the lower cooking chamber.

9. The oven appliance of claim 1, wherein the single heat source is positioned outside of the upper cooking chamber and the lower cooking chamber.

10. An oven appliance, comprising:

a cabinet;

an upper cooking chamber defined in the cabinet adjacent a top portion of the cabinet;

a lower cooking chamber defined in the cabinet below the upper cooking chamber and adjacent a lower portion of the cabinet;

a single heat source in direct thermal communication with an ambient environment around the oven appliance by natural convection; and a fan operable to provide direct thermal communication from the single heat source to one or both of the upper cooking chamber and the lower cooking chamber by forced convection;

a first duct extending from the single heat source to a vent in fluid communication with the ambient environment around the oven appliance, the single heat source in thermal communication with the ambient environment by natural convection through the first duct and the vent; and a second duct extending from an inlet to a broil outlet in the upper cooking chamber, the inlet of the second duct positioned at an intermediate point in the first duct between the single heat source and the vent, whereby the fan is configured to divert heated air from the first duct into the second duct.

11. The oven appliance of claim 10, wherein the fan is positioned in the second duct.

12. The oven appliance of claim 10, wherein the fan is a first fan operable to provide direct thermal communication from the single heat to the upper cooking chamber by forced convection through the second duct, further comprising a third duct extending to a bake outlet in the upper cooking chamber and a second fan configured to urge heated air from the single heat source into the third duct.

13. The oven appliance of claim 12, wherein the third duct extends from an inlet to the bake outlet in the upper cooking chamber, the inlet of the third duct positioned below the vent, whereby the second fan is configured to divert heated air from the first duct into the third duct.

14. The oven appliance of claim 12, further comprising a third fan operable to provide direct thermal communication from the single heat source to the lower cooking chamber by forced convection through a fourth duct extending to a bake outlet in the lower cooking chamber.

15. The oven appliance of claim 14, wherein the fourth duct extends from an inlet to the bake outlet in the lower cooking chamber, the inlet of the fourth duct positioned at an intermediate point in the first duct between the single heat source and the vent, whereby the third fan is configured to divert heated air from the first duct into the fourth duct.

* * * * *